US008418892B2

(12) United States Patent
Geier

(10) Patent No.: US 8,418,892 B2
(45) Date of Patent: Apr. 16, 2013

(54) LOCKABLE SPRAY CAP

(75) Inventor: Adalberto Geier, Trento (IT)

(73) Assignee: Coster Tecnologie Speciali S.p.A., Trento (IT)

( * ) Notice: Subject to any disclaimer, the term of this patent is extended or adjusted under 35 U.S.C. 154(b) by 821 days.

(21) Appl. No.: 11/505,619

(22) Filed: Aug. 17, 2006

(65) Prior Publication Data

US 2008/0041889 A1 Feb. 21, 2008

(51) Int. Cl.
*B65D 83/00* (2006.01)

(52) U.S. Cl.
USPC ..... 222/402.11

(58) Field of Classification Search ..... 222/153.06, 222/153.11, 153.14, 143, 402.11
See application file for complete search history.

(56) References Cited

U.S. PATENT DOCUMENTS

| | | | | |
|---|---|---|---|---|
| 2,678,147 | A | 5/1954 | Abplanalp | |
| 2,761,594 | A * | 9/1956 | Stroh | 222/402.13 |
| 2,887,273 | A * | 5/1959 | Anderson et al. | 239/337 |
| 3,257,044 | A * | 6/1966 | Seaquist | 222/402.13 |
| 3,426,948 | A * | 2/1969 | Stirling | 222/402.11 |
| 4,418,842 | A | 12/1983 | DiLoreto | |
| 4,542,837 | A | 9/1985 | Rayner | |
| 5,279,434 | A * | 1/1994 | Aguirrezabal | 215/331 |
| 5,518,147 | A * | 5/1996 | Peterson et al. | 222/153.07 |
| 5,649,645 | A * | 7/1997 | Demarest et al. | 222/153.07 |
| 5,918,774 | A * | 7/1999 | Lund et al. | 222/153.13 |
| 6,022,357 | A | 2/2000 | Reu et al. | |
| 6,302,302 | B1 * | 10/2001 | Albisetti | 222/153.11 |
| 6,523,722 | B1 | 2/2003 | Clark et al. | |
| 6,758,373 | B2 * | 7/2004 | Jackson et al. | 222/153.11 |
| 2005/0017027 | A1 * | 1/2005 | Yerby et al. | 222/402.13 |
| 2007/0039979 | A1 * | 2/2007 | Strand et al. | 222/402.11 |

* cited by examiner

*Primary Examiner* — Paul R Durand
*Assistant Examiner* — Donnell Long
(74) *Attorney, Agent, or Firm* — The Webb Law Firm, PC

(57) ABSTRACT

An aerosol spray cap 1 is discussed, which comprises two separate pieces, those of a base member 10 and a rotatable twist ring 20. The base member 10 is formed as a single cast piece for removably attaching to the top of an aerosol canister, and provides an actuator button which is integrated with the fluid passageway. This integrated fluid passageway and actuator button 11 interacts with the fluid out pipe of the aerosol canister, and so allows actuation of the aerosol. The rotatable twist ring, provides a means whereby the movement of the integrated fluid passageway and actuator button 11 is prohibited, thereby locking the operation of the aerosol.

16 Claims, 7 Drawing Sheets

LOCKABLE SPRAY CAP

FIELD OF INVENTION

This invention relates to the general field of caps for aerosol canisters, and in particular to the field of lockable actuator caps.

BACKGROUND TO THE INVENTION

The use of aerosols in modern society, is quite common place. Many products ranging from deodorants, hairspray and even spray paint can come in aerosol type canisters. Indeed, any fluids can be held within the canisters and provided under high pressure through an aerosol nozzle to give a fine mist or spray.

With products such as aerosol deodorant and hairspray and the like, there is a tendency for the aerosol canisters to be carried around with the owner, for use during the day. As such, these products are often stored within bags, or jackets or even about the person of the user. Traditional aerosol cap designs, provided a simple plastic nozzle fixed to the fluid out pipe of the aerosol canister, which upon depression opens the valve to allow the flow of fluid through the cap to the aerosol nozzle. Whilst this provides a simple and reliable device, problems can arise with the plastic caps becoming disengaged with the aerosol fluid pipes. This has led to integrated aerosol cap designs, wherein the cap is fitted more securely to the actual aerosol canister, and not held in place with a simple friction fit to the fluid out pipe of the aerosol canisters. In these designs, a larger button is usually provided at the top of the spray cap, to improve the ease of use.

When aerosol canisters are carried in bags or around the person using such products, there is a risk of unwanted or accidental activation of the valve. Clearly, if the canister were to be stored within a bag, it is quite conceivable that further items could push or squash the canister, and in particular the cap, therefore leading to the discharge of the fluid from the canister into the housing or bag. This is clearly quite undesirable, as it wastes the product within the canister, and additionally could lead to damage to the bag or other carrier in which the canister is positioned.

It is therefore an object of the current invention, to provide a spray cap in which the actuator button can be locked in a state which stops the actuation of the valve on the canister. In this manner, it is possible for aerosol canisters to be carried without fear of accidental discharge.

SUMMARY OF THE INVENTION

The above mentioned object is achieved according to the spray cap disclosed in the appended claims. This spray cap, comprises a separate base member and a rotatable twist ring provided thereon. The base member is comprised of an integrated fluid passageway and actuator button, which forms a removable connection with the fluid source. This actuator button is moveable between a first and second position, wherein in the first position the actuation of the fluid source is not performed, and then with movement to the second position the fluid source can be opened to allow fluid to flow through the passageway.

The rotatable twist ring is removably mounted to this base member in a rotatable manner, and is provided with an open and closed orientation. When the rotatable twist ring is in the open orientation, the integrated fluid passageway and actuator button is allowed to move between first and second positions and therefore open the fluid source and allow fluid to flow through the passageway. In the closed orientation, by contrast, the movement of the integrated fluid passageway and actuator button is stopped, and therefore the actuator button cannot move from first to second position. Clearly in the closed orientation, therefore, no fluid can be released from the fluid source, and in essence the aerosol is locked.

Figure 1C:
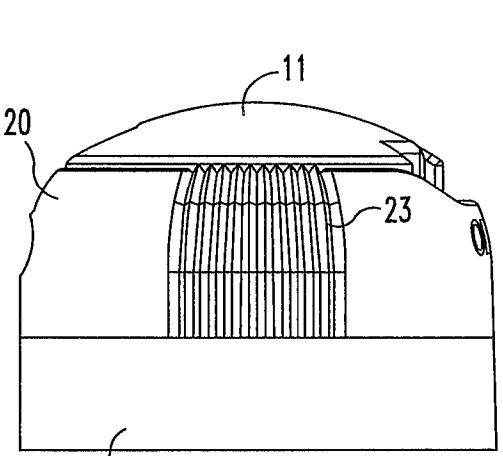
FIG. 1C is a side view of the spray cap shown in FIG. 1A, showing the spray cap in an open position.
Figure 1B:
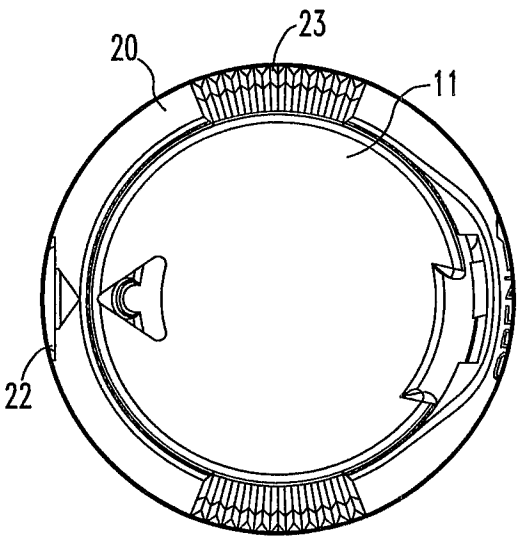
FIG. 1B is a plan view of the spray cap shown in FIG. lA, showing the spray cap in an open position.
Figure 1A:
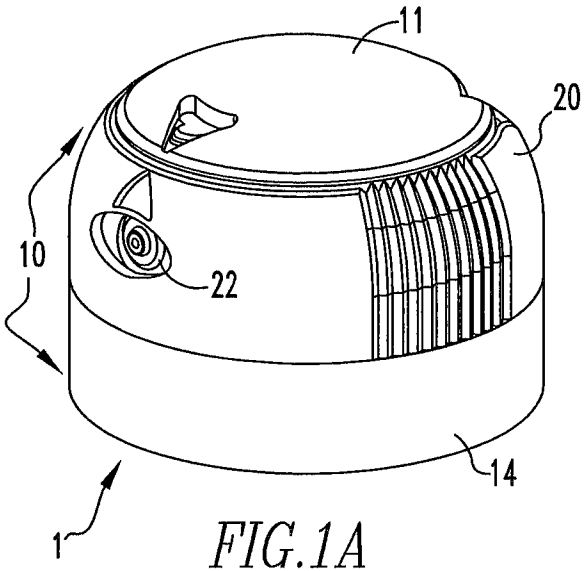
FIG. 1A is a perspective view of a spray cap according to one embodiment of the present invention, showing the spray cap in a open position.
Figure 1D:
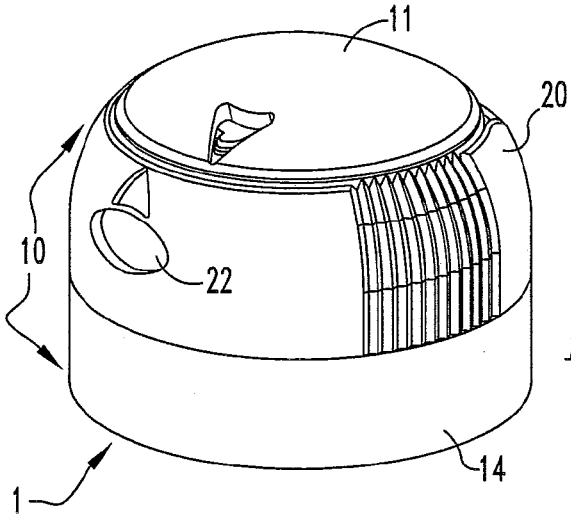
FIG. 1D is a perspective view of the spray cap shown in FIG. 1A, showing the spray cap in a closed position.
Figure 1E:
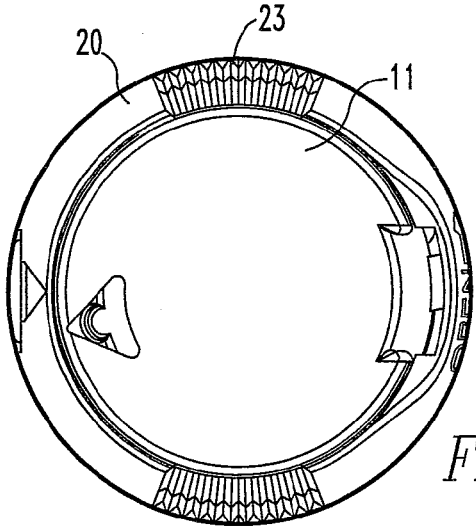
Figure 1F:
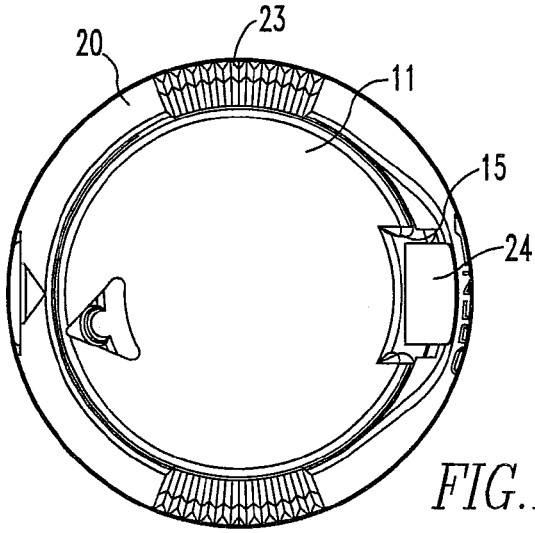
Figure 2A:
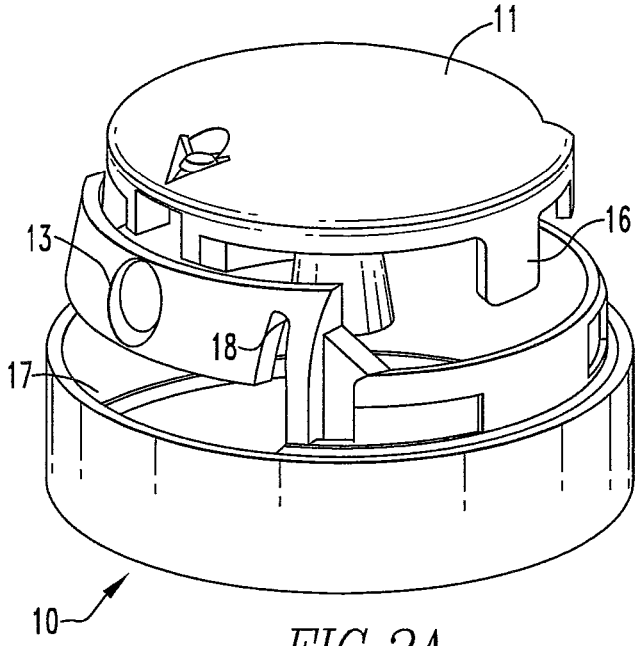
Figure 2B:
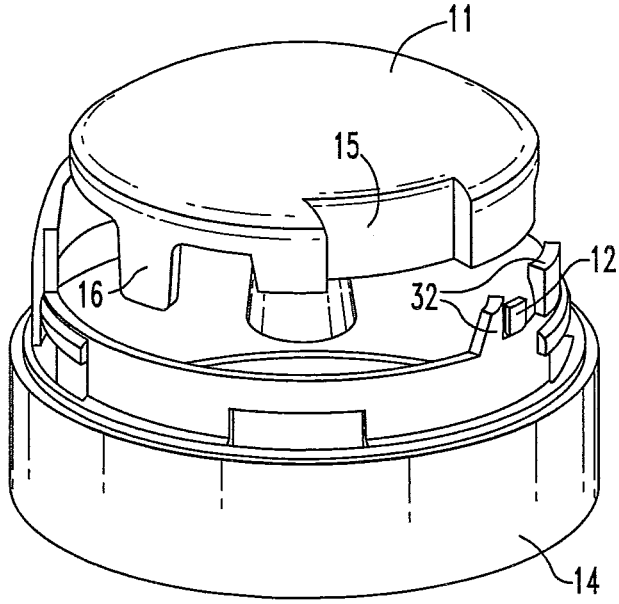
Figure 3A:
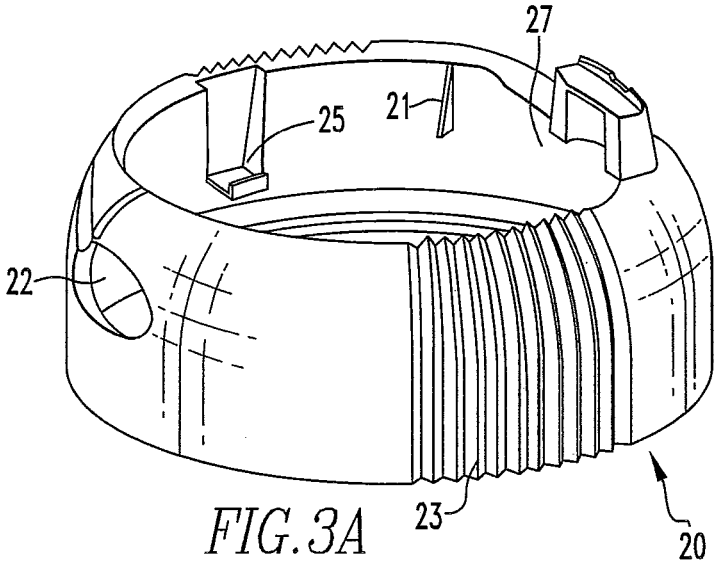

FIG. lE is a plan view of the spray cap shown in FIG. 1A, showing the spray cap in a closed position;

FIG. 1F is a plan view of the spray cap shown in FIG. 1A, showing the spray cap in a closed position with a tamper tab;

FIG. 2A is a front perspective view of the base member of the spray cap shown in FIG. 1A;

FIG. 2B is a rear perspective view of the base member of the spray cap shown in FIG. 1A;

FIG. 3A is a front perspective view of the twist ring of the spray cap shown in FIG. 1A.

Figure 3B:
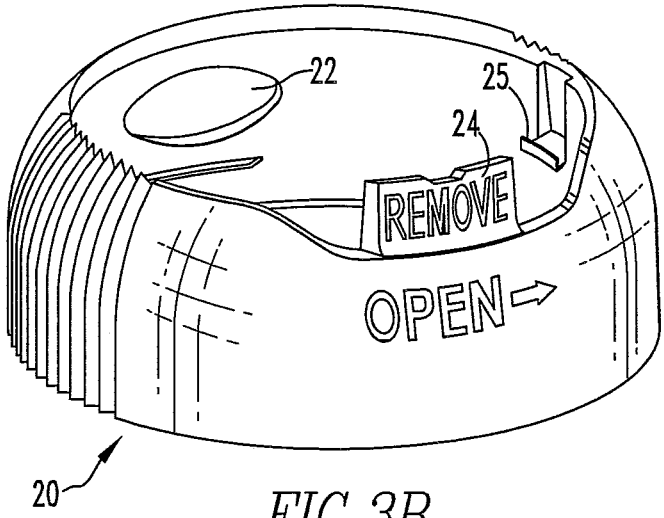

FIG. 3B is a rear perspective view of the twist ring of the spray cap shown in FIG. 1A.

Figure 4A:
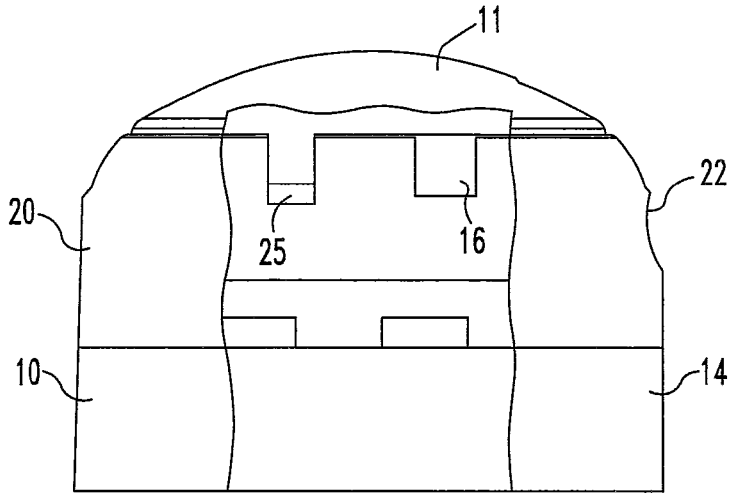
Figure 4B:
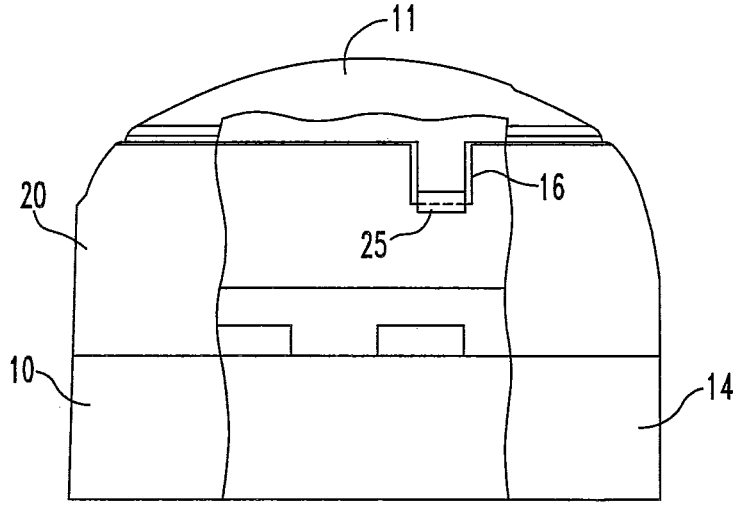
Figure 5A:
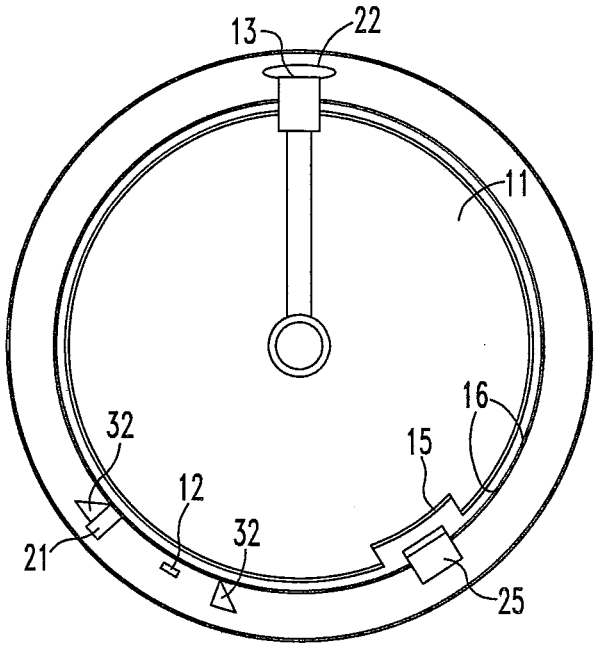
Figure 5B:
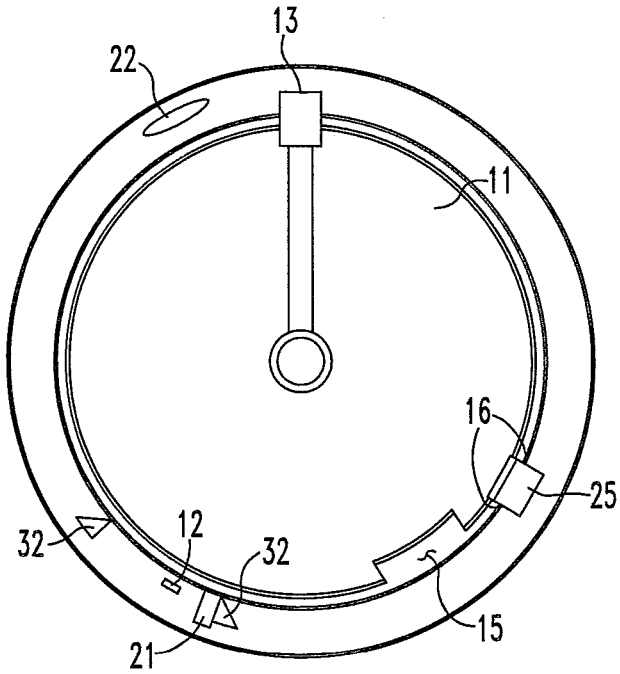
Figure 6A:
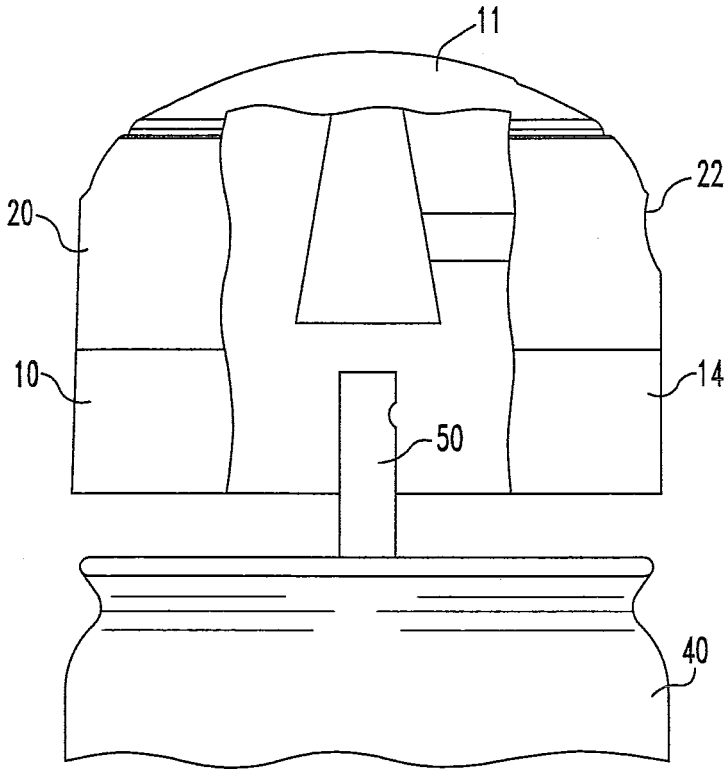
Figure 6B:
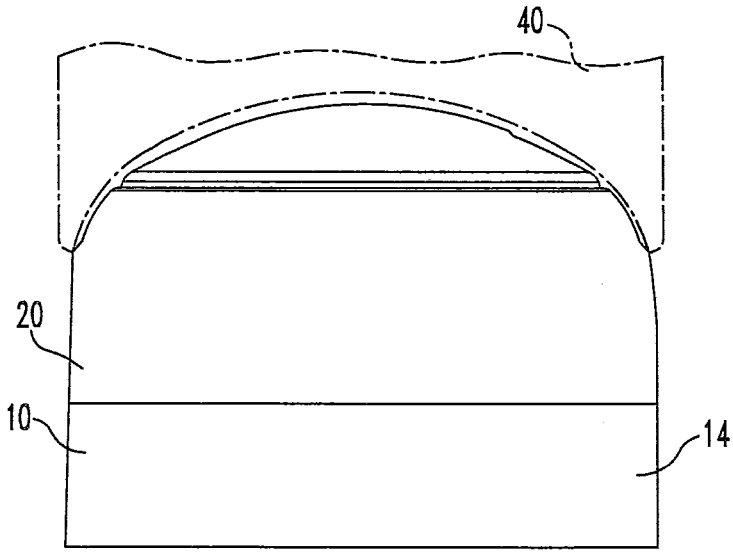

FIG. 4A is a partial cutaway side view of the spray cap shown in FIG. 1A, showing the spray cap in an open position;

FIG. 4B is a partial cutaway side view of the spray cap shown in FIG. 1A, showing the spray cap in a closed position;

FIG. 5A is a bottom schematic view of the spray cap shown in FIG. 1A, showing the spray cap in an open position;

FIG. 5B is a bottom schematic view of the spray cap shown in FIG. 1A, showing the spray cap in a closed position;

FIG. 6A is a side sectional view of the spray cap shown in FIG. 1A, showing an aerosol spray nozzle removably attachable to the spray cap; and FIG. 6B is a side sectional view of the spray cap shown in FIG. 1A, showing an aerosol can stacked on top of the spray cap.

DESCRIPTION OF THE PREFERRED EMBODIMENT

Looking at the FIGS. 1A-1F, the spray cap 1 according to the present invention can be seen. This spray cap 1, comes in two distinct sections, those of a base member 10 and a rotatable twist ring 20 which is used for locking the spray cap 1. As is clear from the FIGS. 1A-1F, the base member 10 extends below and through the centre of the twist ring 20, with the top surface of the base member 10 providing a push button. The rotatable twist ring 20, is held in a rotatable manner on the base member 10. The spray cap has an open position (FIGS. 1A-1C) and a closed position (FIGS. 1D-1F).

As can be seen from FIGS. 2*a* and 2*b*, which are perspective views of the base member 10 of the spray cap 1, the base member 10 is provided as an integrally formed single unit or piece. Furthermore, as can be seen in both FIGS. 2*a* and 2*b*, the base member 10 comprises an integrated fluid passageway and actuator button 11. The fluid passageway begins at the centre of the base member piece 10 and extends upwards towards the actuator button and then horizontally to the outlet of the passageway 13. The first part of the passageway, namely that provided within the centre of the base member piece 10, is designed to interact with the outlet port of a standard aerosol can 40. As such, it is provided that the integrated fluid passageway and actuator button 11 can be moved from a first position to a second position. In the first position, the first part of the fluid passageway is positioned around and over the outlet port of the aerosol canister, but does not interact to open the aerosol valve. When a user moves the integrated fluid passageway and actuator button 11 in a generally downward direction, the rotational moment of this piece around the joint 18 near the passageway end 13 side of the base member 10, actuates the aerosol valve therefore releasing fluid. The fluid enters the passageway formed in the integrated fluid passageway and actuator button 11 of the base member 10, and passes through to the passageway end 13. As can also be seen in FIG. 6A, the passageway end 13 is further provided with an aerosol spray nozzle 50. This nozzle 50 is designed to be removably attachable to the end of the passageway 13, such that if necessary it can be replaced during the spray cap's 1 lifetime.

As discussed above, the integrated fluid passageway and actuator button 11 can be moved between first and second positions, so that the aerosol may be actuated in use. The base member 10 is designed such that the joint 18 attaching the integrated fluid passageway and actuator button 11 to the base member 10, will naturally bias the integrated fluid passageway and actuator button 11 into the first position: that of not actuating the aerosol canister. In so doing, this improves the reliability of the spray cap 1 in general, and stops inadvertent operation of the aerosol.

Additionally, so that the spray cap 1 can be removably attached to an aerosol canister, the lower end side of the base member 10 is provided with fixing means 17. These fixing means 17, are most simply provided by an inwardly protruding ledge which runs around the lower circumference of the base member 10 and interacts with an appropriately positioned ledge or ridge provided on the aerosol canister. In light of this simple attachment means, the spray cap 1 in general may be easily and realiably removably attached to the spray canister.

The rotatable twist ring 20, as shown in the FIGS. 1*a*, 1*b* and 1*c*, is shown in greater detail in FIGS. 3*a* and 3*b*. As can be seen from FIGS. 3*a* and 3*b*, the rotatable twist ring 20 is designed to be a separate and single unit/piece formed for integration with the base member 10. In use, the rotatable twist ring 20 is positioned over the base member 10, in a region defined between the integrated fluid passageway and actuator button 11, and the bottom section of the base member 10. This bottom section of base member 10, is provided by a collar 14. This collar 14 extends below the rotatable twist ring 20, and it is at the bottom inside region of this at which the fixing means 17 are provided. As the rotatable twist ring 20 is designed to be rotated about the central vertical axis of the spray cap 1, the provision of the collar 14 is advantageous in that it allows a user to grip the base member 10 and further rotate the rotatable twist ring 20. When in use, the spray cap 1 is intended to be removably attached to the aerosol canister, and it is further assumed that this attachment will be rigid enough to stop rotation of the base member 10 with respect to the canister. However, with continued use and simple aging of the spray cap 1, it is conceivable that the grip which the base member 10 has on the aerosol canister, could weaken with time, therefore allowing ready rotation of base member 10 and spray cap 1 in general. Provision of this collar 14, therefore, will allow an older spray cap 1 to be used even if the grip provided by the fixing means 17 is not sufficient to stop rotation of the spray cap 1 with respect to the canister.

In order to provide an improved spray cap 1, which has an integrated locking mechanism, such that the accidental discharge of the aerosol is avoided, the rotatable twist ring 20 provides a means for stopping the actuation of the integrated fluid passageway and actuator button 11. That is, the rotatable twist ring 20, will, in certain rotational positions, interfere with the motion of the integrated fluid passageway and actuator button 11 to stop it from moving between first and second positions, and therefore stop the actuation of the aerosol canister. The specific mechanism of this operation is discussed below.

Looking at FIGS. 2*a* and 2*b*: on the underside of the integrated fluid passageway and actuator button 11, there are provided a plurality of legs 16. Any number of legs 16 is conceivable, however it is intended that 1, 2 or possibly 3 should prove sufficient for providing a locking function for the spray cap 1. In particular, it is considered that two legs 16 positioned on either side of the integrated fluid passageway and actuator button 11, will provide sufficient locking characteristics. As can be seen from the diagrams in FIG. 2, the legs 16 project substantially downward from the underside of the integrated fluid passageway and actuator button 11. As shown more clearly in FIGS. 4A and 4B, these legs 16, are designed to interact with ledges 25 which are provided on the inner side of the rotatable twist ring 20 at appropriate positions. FIG. 3A shows clearly the location of these ledges 25. In use, the rotatable twist ring 20 is positioned over the base number 10, in between the collar 14 and the integrated fluid passageway and actuator button 11. The legs 16 protruding from the underside of the integrated fluid passageway and actuator button 11 are located substantially in the same place as the protruding ledges 25 on the inner side of the rotatable twist ring 20. It is intended, that the rotatable twist ring 20 be possessed of an open and closed orientation. That is, in the open orientation (shown in FIG. 4A) the integrated passageway and actuator button 11 is free to move from first to second position thereby actuating the canister; in the closed orientation (shown in FIG. 4B), the integrated fluid passageway and actuator button 11 is stopped from moving between first and second positions, therefore closing the operation of the aerosol canister. When the rotatable twist ring 20 is located around the base member 10 and in the open orientation, the protruding ledges 25 are positioned away from the legs 16 on the underside of the integrated fluid passageway and actuator button 11. As such, there is nothing interfering with the movement of the integrated fluid passageway and actuator button 11 from first to second positions. In this manner, the actuation of the aerosol canister is allowed, and the spray cap 1 can be considered to be in the open orientation. Conversely, when the rotatable twist ring 20 is rotated slightly around the central vertical axis of the spray cap 1, the protruding ledges slide underneath the legs 16 provided on the underside of the integrated fluid passageway and actuator button 11, as shown in FIG. 4*b*, and therefore interfere with its motion. Concretely, the protruding ledges 25, stop the motion of the integrated fluid passageway and actuator button 11 from first to second position, and therefore lock the spray cap 1 into the closed orientation. In this orientation, the spray cap 1 will not function to release any fluid from the aerosol canister.

Whilst in FIGS. 3*a* and 3*b*, the protruding ledges 25 are shown as simple ledges which interact with the bottom of the legs 16, this is not the only possible solution to the problem. Indeed, it is conceivable that the protruding ledges 25 could also be provided by a slot, into which the legs 16 are rotatably moved upon rotating the twist ring 20. That is, instead of just a simple ledge 25, the locking means could be provided by a ledge with a side to grip the inner sides of the legs 16. As such, in this design, the legs 16 on the integrated fluid passageway and actuator button 11, are firmly held and there is no chance of the legs 16 being deformed and allowing actuation of the aerosol canister.

In order to ensure that the rotatable twist ring 20 does not become over rotated, a positioning rib 21 is formed on the inside of the twist ring 20. This can most clearly be seen in FIG. 3*a*, as the vertically aligned rib 21. As shown in FIGS. 5A and 5B, this positioning rib 21 is designed to interact with a flexible tab 12 which is provided on the base member 10. In the same manner as the legs 16 and protruding ledges 25 are positioned such that they interact, the positioning rib 21 and flexible tab 12 are located in appropriate positions on each of the twist ring 20 and base member 10, respectively. That is, when the base member 10 and rotatable twist ring 20 are removably fixed together, the positioning rib 21 is located on one side of the flexible tab. In use, the positioning rib 21 is designed to be rotated from one side of the flexible tab 12 to the other side. At either side of the flexible tab 12, are provided non flexible portions 32 of the base member 10, which stop additional rotation of the twist ring 20. Therefore, when the rotatable twist ring 20 is in the open orientation (shown in FIG. 5A), the legs 16 are not interacting with the protruding ledges 25, and the positioning rib 21 is positioned on one side of the flexible tab 12. Upon rotation of the rotatable twist ring 20 into the closed orientation (shown in FIG. 5B), not only do the legs 16 now interact with the protruding ledges 25, such that the actuation of the integrated fluid passageway and actuator button 11 is stopped, but the positioning rib 21 has passed to the other side of the flexible tab 12. As such, the flexible tab 12 is required to be slightly deformable in its joint with the base member 10, such that the rotating of twist ring 20 is not unduly hindered, but it is clear to the user when the twist ring 20 is in the open or closed orientation.

As can be seen from both FIGS. 1 and 3, the rotatable twist ring 20 is provided with an elongate hole 22. When in use, as has been discussed above, the rotatable twist ring 20 is positioned over the base member 10, in a position between the integrated fluid passageway and actuator button 11 and the collar 14. As such, the rotatable twist ring 20 is actually in a position which aligns with the passageway end 13. In order, therefore, to allow the spray cap 1 to actually function, the elongate hole 22 is provided at an appropriate position on the rotatable twist ring 20. That is, when the rotatable twist ring 20 is located over the base member 10, the elongate hole 22 aligns with the passageway end 13. When the rotatable twist ring 20 is in the open orientation, the passageway end 13 is located at the centre, or as close to the centre as manufacturing tolerances will allow, of the elongate hole 22. In this manner, with depression of the integrated fluid passageway and actuator button 11, the fluid exiting the passageway end 13 is not interfered with by the rotatable twist ring 20, and proper functioning of the spray cap 1 is ensured. When, however, the rotatable twist ring 20 is positioned in the closed orientation, the passageway end 13 is located at one of the elongate ends of the elongate hole 22. That is, when the rotatable twist ring 20 is rotated, the elongate hole 22 passes rotationally past the passageway end 13, and is then positioned such that the passageway end 13 aligns approximately with one of the elongate ends of the elongate hole 22.

One of the advantages of providing the elongate hole 22, is that of generally protecting the spray cap 1. Whilst it is highly unlikely that when in a closed orientation, the aerosol canister 40 could be momentarily discharged, this is not completely impossible. By providing the elongate hole 22 such that when the twist ring 20 is in the closed orientation, the passageway end 13 aligns with one of the elongate ends, the discharge from the aerosol canister 40 is hindered but not completely blocked. This has the advantage, in that the spray cap 1 and passageway end 13 and aerosol spray nozzle 50 would not be subjected to a high pressure from the aerosol canister 40 during accidental or faulty discharge. In this scenario, however, the spray would be sufficiently hindered by the edge of the elongate hole 22 so as to avoid proper aerosol discharge, which if not expected by the user could avoid personal injury or harm. That is, whilst the fluid discharge is not completely blocked by the internal side of the rotatable twist ring 20, because the edge of the elongate hole 22 is positioned substantially near the passageway end 13 and aerosol nozzle, the proper aerosol spray would be interfered with and a less voluminous and directed spray would result. In this manner, should the aerosol 40 be located near to the user's person, and accidental and faulty discharge occur, there is a reduced chance of personal injury.

Whilst the above described arrangement of the elongate hole 22 being positionable such that part of the hole is aligned with the passageway end 13 when the spray cap 1 is locked, it is further conceivable that in the locked position the twist ring 20 is rotated further around the base member 10 such that the elongate hole 22 completely passes the passageway end 13. That is, when the twist ring 20 is located in the locked configuration, the elongate hole 22 passes in front of the passageway end 13 and completely passes said end 13. In this case, the elongate hole 22 then aligns with part of the inner surface provided on the base member 10, and the passageway end 13 aligns with part of the inner surface of the twist ring 20.

An additional feature of the spray cap I as a whole, can be seen from FIG. 1. As is evident from FIG. 6B, the rotatable twist ring 20 extends upwards from the collar 14 towards the integrated fluid passageway and actuator button 11. Towards the upper end of the rotatable twist ring 20, the diameter of the ring 20 reduces slightly to meet the integrated fluid passageway and actuator button 11. This provides a resting surface at the upper part of said twist ring 20, which is advantageous when stacking numerous aerosol canisters 40 utilising the spray cap 1. In general, spray canisters 40 are provided with a lower surface of the can which has a concave surface. This inwardly projecting concave surface provides a rim at the lower end of the aerosol canister 40. The inward taper towards the upper end of the rotatable twist ring 20, is such that when multiple aerosol canisters 40 are stacked on top of each other, the concave lower surface and rim will rest on the rotatable twist ring, and no pressure will be applied to the integrated fluid passageway and actuator button 11. In providing the spray cap 1 with such a configuration, it is possible for storage of aerosol canisters 40 one on top of each other without fear of excessive pressure being provided on the integrated fluid passageway and actuator button 11 on the spray cap 1 on the lower aerosol canister 40. Such a feature clearly removes the danger of unwanted damage occurring to the spray cap 1 during storage, and further avoids excessive stress on the locking mechanism of the integrated fluid passageway and actuator button 11.

As can be seen from FIGS. 1*a*, 1*b* and 1*c* as well as FIGS. 3*a* and 3*b*, the external sides of the rotatable twist ring 20 are provided with a series of gripping ribs 23. These are intended to improve the grip that the user has on the rotatable twist ring 20 when in use, therefore improving the ease of operability of the spray cap 1. Whilst two regions of gripping ribs 23 are shown on the rotatable twist ring 20 in the figures, it is conceivable that the whole of the rotatable twist ring 20 could be provided with such ribs, or multiple sections could also be provided.

In order for the user to know whether the aerosol to which the spray cap 1 is attached, has been actuated prior to purchase, a tamper tab 24 may be provided. This tab can best be seen in FIGS. 3*a* and 3*b*, as extending from the side opposite the elongate hole 22. As shown in FIG. 1F, it is intended that this tamper tab 24, be located in a position such that it would align with a recess 15 on the back of the integrated fluid passageway and actuator button 11 of the base member 10. This recess 15 can be clearly seen in FIG. 2*b*. In use, when the rotatable Twist ring 20 is positioned over the base member 10, the tamper tab 24 is located within the region of the recess 15 and the rotatable twist ring 20 is in the closed orientation. In this manner, it is almost certain that the actuation of the aerosol canister is stopped by the virtue of the legs 16 and protruding ledges 25, as discussed above. In order to allow the operation of the spray cap 1, the rotatable twist ring 20 must be moved into the open orientation, by rotating the rotatable twist ring 20. In order to do this, the tamper tab 24 must be removed from the rotatable twist ring 20, and therefore allow the rotation around the central vertical axis of the base member 10. In this manner, a simple yet effective mechanism for insuring that the purchased aerosol canister has not been discharged may be provided.

Whilst the above discussion is presented for the spray cap 1 of the invention, it is not intended in any way to limit the scope of protection. Indeed, many of the features disclosed above can be combined to form the spray cap 1. This true scope of the invention is as defined by the attached claims.

What is claimed is:

1. A spray cap comprising:

a base member, wherein the base member comprises an integrated fluid passageway and an actuator, the integrated fluid passageway and the actuator button being connectable to a fluid source and moveable between a first and a second position, wherein the first position does not actuate the fluid source and the second position does actuate the fluid source;

a rotatable twist ring, the rotatable twist ring being removably mountable to the base member in a rotatable manner, the base member having a top surface extending through a central opening on the twist ring and defining a push surface for actuating the actuator button, the twist ring having an open and closed orientation, wherein when in the open orientation, the integrated fluid passageway and the actuator button are free to move between the first and second position, and when in the closed orientation, ledges on an internal side of the rotatable twist ring interact with legs on the integrated fluid passageway and the actuator button to stop the movement of the integrated fluid passageway and the actuator button from the first to the second position, wherein the twist ring has a central opening that extends between an open bottom portion and an open top portion and is provided with a hole in a position which aligns with an end of the passageway in the integrated fluid passageway and the actuator button, the hole being positioned in the twist ring such that the passageway end is aligned with a centre of the hole when the twist ring is in the open orientation, and when the twist ring is in the closed position the hole is positioned away from the passageway end such that the passageway end aligns with an internal surface of the twist ring and wherein the twist ring is positioned around the base member and extends upward from a collar which is formed at a lower part of the base member toward the integrated fluid passageway and the actuator button, such that the collar of the base member extends beyond a lower edge of the twist ring; and a positioning rib formed on the inside of the twist ring, the positioning rib interacts with a flexible tab provided on the base member in such a manner that the twist ring is oriented in the open orientation when the positioning rib is at one side of the flexible tab, and the twist ring is oriented in the closed position when the positioning rib is at the other side of the flexible tab; the flexible tab being formed in a flexible manner so as to deform to allow the passage of the positioning rib between the open and closed orientations.

2. The spray cap according to claim 1, wherein further the base member is formed as a single piece incorporating the integrated fluid passageway and actuator button.

3. The spray cap according to claim 2, wherein:

the integrated fluid passageway and actuator button is formed with the base member to be rotatable around a joint between the first and second positions, and wherein the base member is formed such that the integrated fluid passageway and actuator button returns to the first position after actuation.

4. The spray cap according to claim 1, further comprising fixing means on the base member, for removably attaching the spray cap to an aerosol canister, the fixing means having a ledge that runs around the lower circumference of the base member and configured to interact with an appropriately positioned ridge provided on the aerosol canister.

5. The spray cap according to claim 1, wherein gripping ribs are formed on at least a section of the rotatable twist ring.

6. The spray cap according to claim 1, wherein an aerosol spray nozzle is removably attachable to the end of the passageway of the integrated fluid passageway and actuator button.

7. The spray cap according to claim 1, wherein a tamper tab is provided on the rotatable twist ring which is aligned with a recess on the integrated fluid passageway and actuator button when the twist ring is in the closed orientation, such that the tamper tab is positioned within the recess and stops the rotation of the twist ring until it is removed.

8. The spray cap according to claim 1, wherein the upper section of the rotatable twist ring tapers inwardly to provide a ledge in the region of the integrated fluid passageway and actuator button, the ledge being sized such that when an aerosol canister is stacked on top of the spray cap an edge of a concave lower surface will rest on the ledge and not contact the integrated fluid passageway and actuator button.

9. A spray cap comprising:

a base member;

a rotatable twist ring; and a fixing means on the base member for removably attaching the spray cap to an aerosol canister, the fixing means having a ledge that extends around the lower circumference of the base member and interacts with an appropriately positioned ridge provided on the aerosol canister, wherein the base member comprises an integrated fluid passageway and an actuator button, the integrated fluid passageway and the actuator button being connectable to a fluid source and moveable between a first and a second position, wherein the first position does not actuate the fluid source and the second position does actuate the fluid source;

the rotatable twist ring being removably mountable to the base member in a rotatable manner, the base member having a top surface extending through a central opening on the twist ring and defining a push surface of the actuator button, wherein when in the open orientation, the integrated fluid passageway and the actuator button are free to move between the first and the second position, and when in the closed orientation, the integrated fluid passageway and the actuator button are hindered from moving between the first and the second positions, wherein further the twist ring has a central opening that extends between an open bottom portion and an open top portion and is provided with a hole in a position which aligns with an end of the passageway in the integrated fluid passageway and the actuator button, the hole being positioned in the twist ring such that the passageway end is aligned with a centre of the hole when the twist ring is in the open orientation, and the passageway end is aligned with an end of the hole, when the twist ring is in the closed orientation.

10. The spray cap according to claim 9, wherein the twist ring is positioned around the base member and extends upward from a collar which is formed at a lower part of the base member toward the integrated fluid passageway and actuator button, such that the collar of the base member extends beyond a lower edge of the twist ring.

11. The spray cap according to claim 9, further comprising:

a positioning rib formed on the inside of the twist ring, which interacts with a flexible tab provided on the base member in such a manner that the twist ring is oriented in the open orientation when the positioning rib is at one side of the flexible tab, and the twist ring is oriented in the closed position when the positioning rib is at the other side of the flexible tab;

the flexible tab being formed in a flexible manner so as to deform to allow the passage of the positioning rib between the open and closed orientations.

12. The spray cap according to claim 9, wherein the upper section of the rotatable twist ring tapers inwardly to provide a ledge in the region of the integrated fluid passageway and actuator button, the ledge being sized such that when an aerosol canister is stacked on top of the spray cap an edge of a concave lower surface will rest on the ledge and not contact the integrated fluid passageway and actuator button.

13. A spray cap comprising a base member and a rotatable twist ring, wherein the base member comprises an integrated fluid passageway and an actuator button, the integrated fluid passageway and the actuator button being connectable to a fluid source and moveable between a first and a second position, wherein the first position does not actuate the fluid source and the second position does actuate the fluid source;

the rotatable twist ring being removably mountable to the base member in a rotatable manner, the base member having a top surface extending through a central opening on the twist ring and defining a push surface of the actuator button, the twist ring having an open and closed orientation, wherein when in the open orientation, the integrated fluid passageway and the actuator button are free to move between the first and second position, and when in the closed orientation, the integrated fluid passageway and the actuator button are hindered from moving between the first and the second positions, wherein further the twist ring has a central opening that extends between an open bottom portion and an open top portion and is positioned around the base member and extends upward from a collar which is formed at a lower part of the base member toward the integrated fluid passageway and the actuator button, such that the collar of the base member extends beyond a lower edge of the twist ring.

14. The spray cap according to claim 13, wherein the twist ring is provided with a hole in a position which aligns with an end of the passageway in the integrated fluid passageway and actuator button, the hole being positioned in the twist cap such that the passageway end is aligned with a centre of the hole when the twist cap is in the open orientation, and the passageway end is aligned with an end of the hole, when the twist ring is in the closed orientation.

15. The spray cap according to claim 13, wherein the twist ring is provided with a hole in a position which aligns with an end of the passageway in the integrated fluid passageway and actuator button, the hole being positioned in the twist ring such that the passageway end is aligned with a centre of the hole when the twist ring is in the open orientation, and when the twist ring is in the closed position the hole is positioned away from the passageway end such that the passageway end aligns with an internal surface of the twist ring.

16. The spray cap according to claim 13, wherein the upper section of the rotatable twist ring tapers inwardly to provide a ledge in the region of the integrated fluid passageway and actuator button, the ledge being sized such that when an aerosol canister is stacked on top of the spray cap an edge of a concave lower surface will rest on the ledge and not contact the integrated fluid passageway and actuator button.

* * * * *